US009200756B2

(12) United States Patent
Park et al.

(10) Patent No.: US 9,200,756 B2
(45) Date of Patent: Dec. 1, 2015

(54) LIGHTING DEVICE

(75) Inventors: Jong Chan Park, Seoul (KR); Young Jin Kim, Seoul (KR); Eon Ho Son, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 25 days.

(21) Appl. No.: 13/558,614

(22) Filed: Jul. 26, 2012

(65) Prior Publication Data

US 2013/0148328 A1 Jun. 13, 2013

(30) Foreign Application Priority Data

Dec. 12, 2011 (KR) ..... 10-2011-0132519
Dec. 13, 2011 (KR) ..... 10-2011-0133503
Dec. 20, 2011 (KR) ..... 10-2011-0138332
Feb. 1, 2012 (KR) ..... 10-2012-0010203

(51) Int. Cl.
*F21V 9/16* (2006.01)
*F21V 3/02* (2006.01)
*F21K 99/00* (2010.01)

(52) U.S. Cl.
CPC .... *F21K 9/13* (2013.01); *F21K 9/56* (2013.01)

(58) Field of Classification Search
CPC ..... F21K 2/00; F21K 9/13; F21K 9/56; F21V 3/0481; F21V 7/045
USPC ..... 362/84, 227, 230, 235, 249.01, 249.02, 362/257, 311.01, 311.02, 362, 363, 311.06, 362/311.09
See application file for complete search history.

(56) References Cited

U.S. PATENT DOCUMENTS

2005/0068776 A1* 3/2005 Ge ..... 362/296
2009/0086492 A1* 4/2009 Meyer ..... 362/294
2010/0110676 A1* 5/2010 Falicoff et al. ..... 362/235
2010/0208468 A1* 8/2010 Lee et al. ..... 362/311.02
2010/0265693 A1* 10/2010 Ryu et al. ..... 362/84
2013/0121002 A1* 5/2013 Lin et al. ..... 362/296.04

FOREIGN PATENT DOCUMENTS

KR 10-2006-0071033 A 6/2006
KR 10-2008-0040086 A 5/2008
KR 10-2011-0099513 A 9/2011
WO WO 2010128419 A1 * 11/2010 ..... F21K 99/00
WO WO 2011/062089 A1 5/2011

OTHER PUBLICATIONS

International Search Report dated Feb. 28, 2013.

* cited by examiner

*Primary Examiner* — Evan Dzierzynski
*Assistant Examiner* — Naomi M Wolford
(74) *Attorney, Agent, or Firm* — Ked & Associates, LLP

(57) ABSTRACT

A lighting device may include a heat sink and a mounting surface provided a prescribed distance over the heat sink. A plurality of light emitting diodes may be provided on the mounting surface. The plurality of light emitting diodes may be positioned a prescribed distance from a point on the mounting surface. An enclosure having a prescribed shape may be provided over the mounting surface and the plurality of light emitting diodes. The enclosure may include luminescent material such that a wavelength of light emitted by the enclosure is different from a wavelength of light emitted by the plurality of light emitting diodes. A bulb may be provided over the heat sink to surround the enclosure.

14 Claims, 24 Drawing Sheets

B/A = 0.35

B/A = 0.5

B/A = 0.65

B/A = 0.8 r/R = 0.7 r/R = 0.78 r/R = 0.875 r/R = 1 m/n = 0.9

LIGHTING DEVICE

CROSS-REFERENCE TO RELATED APPLICATION(S)

This application claims priority under 35 U.S.C. §119 to Korean Application Nos. 10-2011-0132519 filed in Korea on Dec. 12, 2011, 10-2011-0133503 filed in Korea on Dec. 13, 2011, 10-2011-0138332 filed in Korea on Dec. 20, 2011, and 10-2012-0010203 filed in Korea on Feb. 1, 2012, whose entire disclosures are hereby incorporated by reference.

BACKGROUND

1. Field

A lighting device is disclosed herein.

2. Background

Lighting devices are well known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
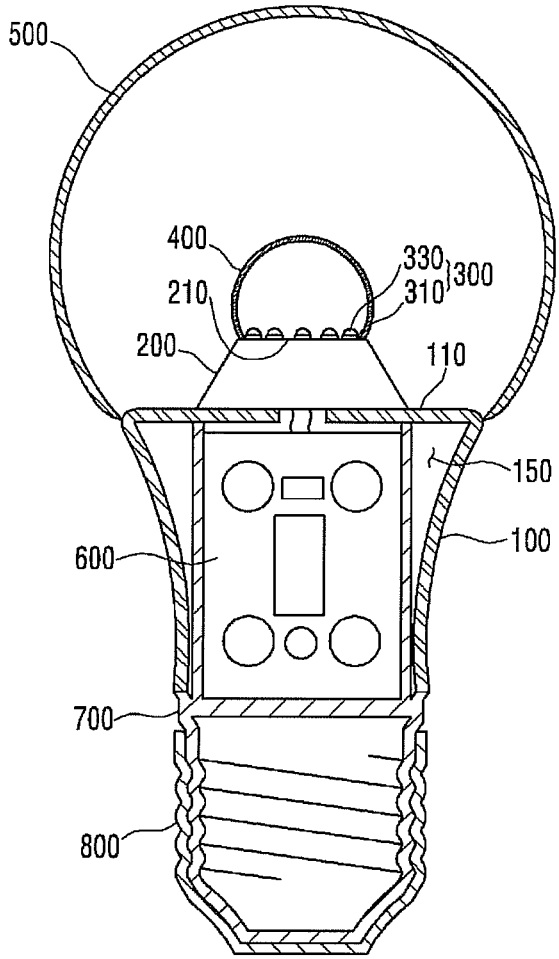
FIG. 1 is a cross-sectional view of a lighting device according to an embodiment.

The embodiments of the present disclosure may be described in detail with reference to the accompanying drawings. It should be appreciated that various elements represented in the drawings and/or the following description may be magnified, omitted or schematically shown simply for the purpose of convenience and ease of description. Moreover, the drawing may not be to scale.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

A light emitting diode (LED) is an energy device for converting electric energy into light energy. Compared with other types of light sources, such as incandescent light, the LED has higher conversion efficiency, lower power consumption and a longer life span. Hence, LED based lighting devices may provide various advantages.

FIG. 1 is a cross-sectional view of a lighting device according to one embodiment. The lighting device may be a bulb-type lighting device. The lighting device may include a heat sink 100, a member 200, a light source unit 300, an optical part 400, a cover 500, a power source 600, an inner case 700 and a socket 800.

The heat sink 100 may receive heat generated from the light source unit 300 and the power source 600 and radiates to the outside. Therefore, the heat sink 100 may be formed of a metallic material or a resin material, each of which has high heat radiation efficiency. For example, the heat sink 100 may include at least one of Al, Ni, Cu, Ag, Sn, or another appropriate type of thermally conductive material.

The member 200 may be a mounting surface or platform. The heat sink 100 may include a placement portion 110 at which the mounting platform 200 is provided. The placement portion 110 may be a portion of the outer surface of the heat sink 100 and may be a flat surface.

The mounting platform 200 may be a protrusion that protrudes from the placement portion 110 to provide a raised surface for mounting the light source unit 300. The mounting platform 200 may have various shapes such as a conical shape, a cylindrical shape, hexagonal shape, or another appropriate shape. The mounting platform 200 may also be referred to herein as a mounting block or a mounting surface.

A portion of the placement portion 110 of the heat sink 100 may include an opening for a wire or a pin to be routed through the placement portion 110, each of which may transfer electric power from the power source 600 to the light source unit 300.

In the drawings, although the heat sink 100 and the mounting platform 200 are represented as separate components, the present disclosure is not limited thereto. For example, the heat sink 100 and the mounting platform 200 may be integrally formed.

The heat sink 100 may include a receiver 150 for receiving the power source 600 and the inner case 700 (inner housing). The receiver 150 may be a recess formed inside the heat sink 100.

The heat sink 100 may be coupled to the cover 500. Through the coupling of the heat sink 100 and the cover 500, the placement portion 110 of the heat sink 100 may be surrounded by the cover 500. The heat sink 100 and the cover 500 may be coupled to each other by the use of various manners such as a rotary coupling (e.g., using threads), interference or friction fit, or the like. Moreover, the cover may have various shapes including, for example, a bulb.

The heat sink 100 may be coupled to the inner case 700 (housing). The coupling of the heat sink 100 and the inner case 700 may be performed by the use of various manners such as using a screw for fastening, or the like.

The mounting platform 200 may be disposed on the heat sink 100. Specifically, the mounting platform 200 may be disposed on the placement portion 110 of the heat sink 100. The mounting platform 200 may be disposed in the central portion of the placement portion 110 of the heat sink 100.

The mounting platform 200 may cause the light source unit 300 to be disposed adjacent to the inner central portion of the cover 500. Since the light source unit 300 can be disposed in the inner central portion of the cover 500 by the mounting platform 200, light which has been emitted from the light source unit 300 and has transmitted through the optical part 400 may be distributed in a lateral direction as well as in an upward direction of the lighting device according to the embodiment. For example, raising the position of the light source unit 300 may improve light distribution characteristics, e.g., omni-directional light distribution.

The mounting platform 200 may have a predetermined height. Specifically, the mounting platform 200 may have a predetermined height from the placement portion 110 of the heat sink 100. For example, the mounting platform 200 may have a predetermined height from the placement portion 110 of the heat sink 100, and the width of the lower portion of the mounting platform 200 adjacent to the placement portion 110 may be greater than the width of the upper portion of the mounting platform 200 in which the light source unit 300 is disposed. The width of the mounting platform 200 may become greater toward the lower portion thereof from the upper portion thereof.

A plurality of the light source units 300 may be disposed on the mounting platform 200. Specifically, the upper portion of the mounting platform 200 may include a placement portion 210 (e.g., placement or mounting surface). The plurality of the light source units 300 may be disposed on the placement portion 210. Here, the placement portion 210 may be a portion of the outer surface of the mounting platform 200 and may be flat.

The mounting platform 200 may be coupled to the optical part 400. By the coupling of the mounting platform 200 and the optical part 400, the light source unit 300 is not exposed outward. In other words, the light source unit 300 is sealed by the optical part 400 and the placement portion 210 of the mounting platform 200. The inside of the mounting platform 200 may be penetrated by a wire, etc., from the power source 600. Moreover, The material of the mounting platform 200 may be the same as or similar to that of the heat sink 100. That is to say, the material is able to transfer heat generated from the light source unit 300 to the heat sink 100. Moreover, the outer surface of the mounting platform 200 may be coated with a reflective film which is able to easily reflect light incident from the light source unit 300 and the cover 500. Here, the reflective film may be a white pigment or a mirror surface.

In the drawings, though the mounting platform 200 and the heat sink 100 are represented as separate components, there is no limit to this. That is, the mounting platform 200 and the heat sink 100 may be integrally formed. Specifically, the mounting platform 200 may be a component of the heat sink 100. When the mounting platform 200 is a component of the heat sink 100, the mounting platform 200 may be a projection projecting upward from the placement portion 110 of the heat sink 100.

The light source unit 300 is spaced apart from the heat sink 100 at a predetermined interval. Specifically, the light source unit 300 is spaced apart from the placement portion 110 of the heat sink 100 at a predetermined interval. For this purpose, the mounting platform 200 may be disposed between the light source unit 300 and the heat sink 100.

The light source unit 300 may include a substrate 310 and a light emitting device 330. The light source unit 300 is electrically connected to a wire from the power source 600. The substrate 310 may be disposed on the placement portion 210 of the mounting platform 200. The light emitting device 330 is disposed on the substrate 310. Although FIG. 1 shows that one light emitting device 330 is disposed on one substrate 310, there is no limit to this. For another example, a plurality of the light emitting devices 330 may be disposed on one substrate 310.

The substrate 310 is formed by printing circuit patterns on an insulator. For example, the substrate 310 may include a general printed circuit board (PCB), a metal core PCB, a flexible PCB, a ceramic PCB and the like. Here, the substrate 310 may be a chips on board (COB) allowing an unpackaged LED chip to be directly bonded thereon. The COB includes a ceramic material and can obtain thermal resistance and insulation. The substrate 310 may be formed of a material which efficiently reflects light. For example, the surface of the substrate 310 may be coated with a pigment having a color capable of efficiently reflecting light, for example, white, silver and the like.

The light emitting device 330 may be disposed on the substrate 310. Also, a plurality of the light emitting devices 330 may be disposed on the substrate 310. The light emitting device 330 may be a light emitting diode chip emitting blue, red or green light or may be a light emitting diode chip emitting white light. Furthermore, the light emitting device 330 may be a light emitting diode chip emitting UV. Here, the light emitting diode chip may be a lateral type or a vertical type.

The light emitting device 330 may be molded by a lens. The lens is able to adjust an orientation angle or a direction of light emitted from the light emitting device 330. The lens has a hemispherical shape. The inside of the lens may be entirely filled with a light transmitting resin like a silicon resin or an epoxy resin without an empty space.

Here, the light transmitting resin may entirely or partially include a distributed fluorescent or luminescent material. When the light emitting device 330 is a light emitting diode emitting blue light, the fluorescent material included in the light transmitting resin may include at least any one selected from the group consisting of a garnet based material (YAG, TAG), a silicate based material, a nitride based material and an oxynitride based material. Though natural light (white light) can be created by allowing the light transmitting resin to include only yellow fluorescent material, the light transmitting resin may further include a green fluorescent material or a red fluorescent material in order to improve a color rendering index and to reduce a color temperature.

When the light transmitting resin is mixed with many kinds of fluorescent materials, an addition ratio of the color of the fluorescent material may be formed such that the green fluorescent material is more used than the red fluorescent material, and the yellow fluorescent material is more used than the green fluorescent material. The light transmitting resin may be divided into a plurality of layers. For example, the light transmitting resin may be formed by stacking a layer having a red fluorescent material, a layer having a green fluorescent material and a layer having a yellow fluorescent material.

The above described light transmitting resin may also be applied to the cover 500. For example, the cover 500 may be formed of luminescent material to change a wavelength of light emitted from the light emitting device 330 or the light transmitting resin may fill the cavity of the cover 500. In this way, a wavelength of light emitted from the cover 500 may have a wavelength that is different than a wavelength of light emitted at the light emitting device 330.

Figure 2:
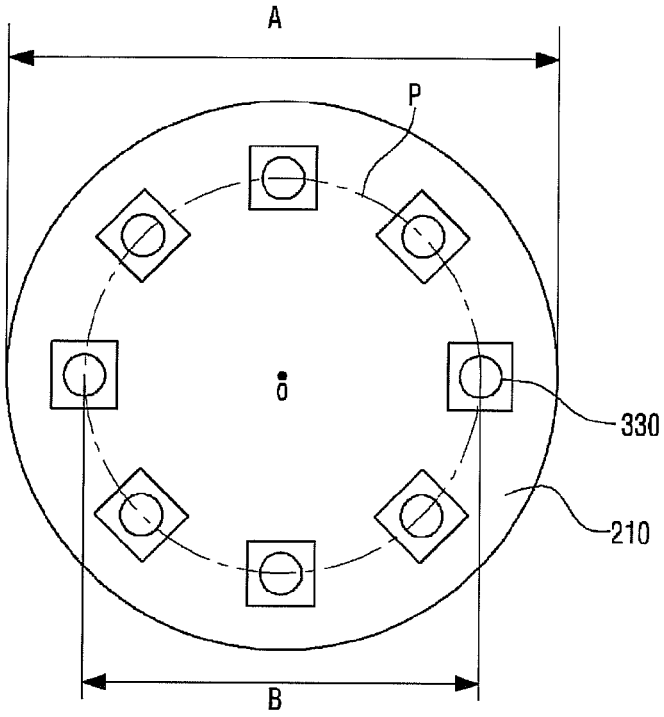
FIG. 2 is a top view of a light source unit of the lighting device of FIG. 1.

FIG. 2 is a top view of the light source unit 300 of FIG. 1. The arrangement of the light emitting devices 330 on the substrate 310 may have a predetermined relationship with the placement portion 210 or the substrate 310. The plurality of the light emitting devices 330 may be arranged on a virtual trace "P". Specifically, the center of each light emitting device 330 may be arranged on the virtual trace "P".

Here, the trace "P" may have a shape corresponding to a shape of the placement portion 210. For example, when the placement portion 210 has a circular shape, the trace "P" may also have a circular shape. It should be appreciated that the shape of the trace "P", or the pattern in which the light emitting devices 330 are positioned, is not limited to a circular shape. For example, if the placement portion 210 has an elliptical shape, the trace "P" may have an elliptical shape. If the placement portion 210 has a polygonal shape, the trace "P" may have a polygonal shape. Other shapes and patterns may also be used.

The trace "P" may have a predetermined relationship with the placement portion 210. For description of the relation, it is assumed that the diameter of the placement portion 210 is designated as "A" and the diameter of the trace "P" is designated as "B". Moreover, simply for ease of description, it is assumed in this embodiment that the optical part 400 of FIG. 1 has a spherical shape is used. Meanwhile, the trace "P" may be formed on a substrate 310 on which the light emitting device 330 may be disposed or another appropriate mounting surface, instead of on the placement portion 210.

A ratio of "B" to "A" (B/A) may be equal to or greater than 0.65 and less than and not equal to 1. For example, when "A" is 1, "B" may be greater than or equal to 0.65 and less than 1. Also, a ratio of a distance from the center "O" of the light source unit 300 to the light emitting device 330 to a distance from the center "O" of the light source unit 300 to the outermost edge of the placement portion 210 (mounting surface) may be equal to or greater than 0.65 and less than and not equal to 1. Here, the center "O" of the light source unit 300 may correspond to the center of the light emitting devices 330 positioned according to a prescribed pattern. For example, the center "O" may refer to a virtual point spaced apart from the light emitting device 330 at a constant interval such as a circle pattern as shown.

When B/A is equal to or greater than 0.65 and less than and not equal to 1, a lateral distribution of light emitted from the cover 500 of FIG. 1 may be improved. This will be described in further detail with reference to FIGS. 3 to 6.

Figure 3:
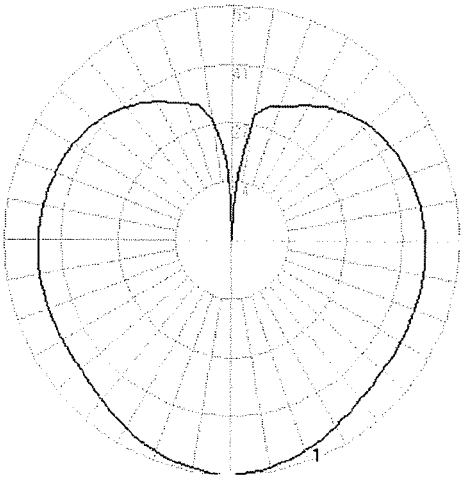
FIGS. 3 and 4 are light distribution charts of light emitted from the lighting device of FIG. 1, in which a ratio B/A is less than 0.65, wherein A and B are distances as illustrated in FIG. 2.
Figure 4:
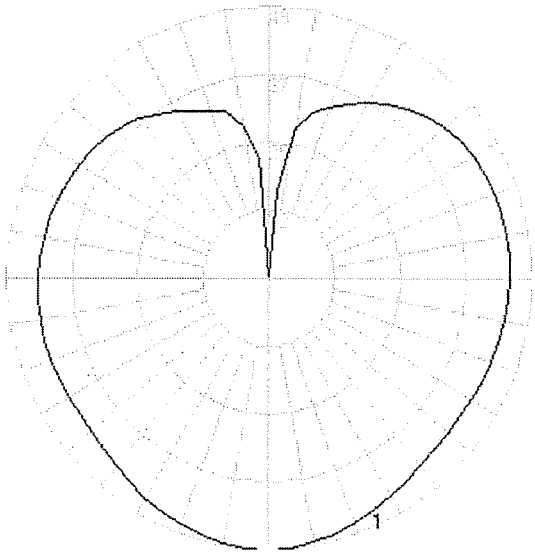
Figure 5:
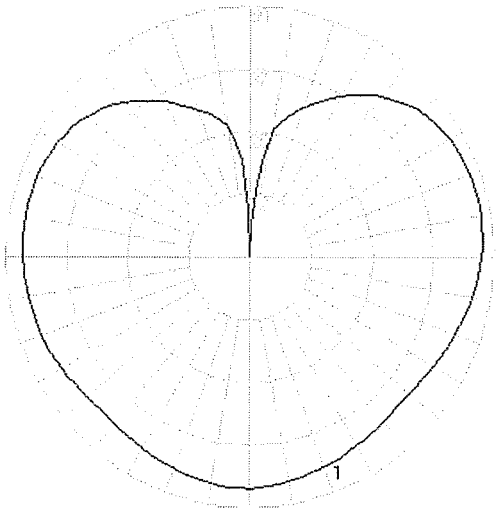
FIGS. 5 and 6 are light distribution charts of light emitted from the lighting device of FIG. 1, in which a ratio B/A is greater than or equal to 0.65, wherein A and B are distances as illustrated in FIG. 2.
Figure 6:
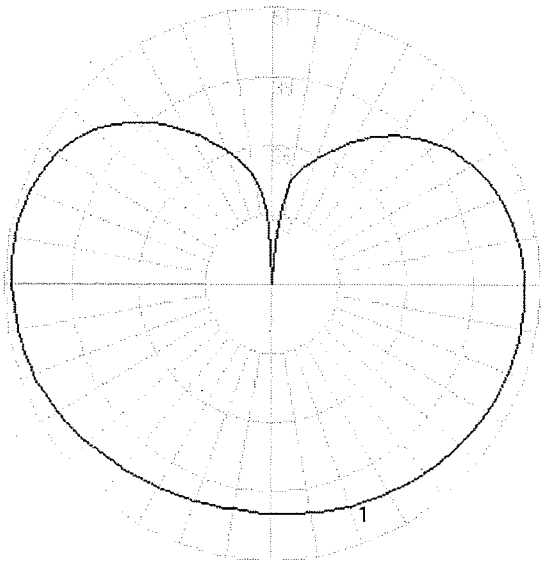

FIGS. 3 and 4 are light distribution charts of light emitted from the lighting device of FIG. 1, in which a ratio B/A is less than and not equal to 0.65. FIGS. 5 and 6 are light distribution charts of the light emitted from the lighting device of FIG. 1, in which a ratio B/A is equal to or greater than 0.65.

Referring to FIGS. 3 to 6, it can be found that the lateral light distribution is improved with the increase of in the ratio B/A. In particular, when the ratio B/A is equal to or greater than 0.65, the lateral light distribution may be optimized.

Referring back to FIG. 1, the optical part 400 may be disposed on the mounting platform 200. The optical part 400 may be disposed between the light source unit 300 and the cover 500. Here, the optical part 400 may be spaced apart from the light source unit 300 at a predetermined interval and may be spaced apart from the cover 500. The optical part 400 surrounds the light source unit 300 and may be coupled to the placement portion 210 of the mounting platform 200.

The optical part 400 may change the wavelength of the light emitted from the light source unit 300. For this purpose, the optical part 400 may include fluorescent material. The optical part 400 may have at least one of a yellow fluorescent material, a green fluorescent material or a red fluorescent material. The yellow fluorescent material, the green fluorescent material and the red fluorescent material may be excited by blue light emitted from the light source unit 300 and emit yellow light, green light and red light. More specifically, the yellow fluorescent material responds to blue light (wavelength of 430 nm to 480 nm) and emits light having a dominant wavelength of 540 nm to 585 nm. The green fluorescent material responds to blue light (wavelength of 430 nm to 480 nm) and emits light having a dominant wavelength of 510 nm to 535 nm. The red fluorescent material responds to blue light (wavelength of 430 nm to 480 nm) and emits light having a dominant wavelength of 600 nm to 650 nm. The yellow fluorescent material may be a silicate based fluorescent material or a YAG based fluorescent material. The green fluorescent material may be a silicate based fluorescent material, a nitride based fluorescent material or a sulfide based fluorescent material. The red fluorescent material may be a nitride based fluorescent material or a sulfide based fluorescent material.

The optical part 400 may have a hollow spherical shape. In the present specification, the "sphere" may include not only a geometrically perfect sphere but also a general sphere of which the portions have been removed. The "sphere" may also include a sphere of which a portion is not a general sphere.

The optical part 400 has an outer surface and an inner surface. The optical part 400 has a predetermined thickness. Moreover, the optical part 400 may have a predetermined relationship with the light source unit 300. The relation between the optical part 400 and the light source unit 300 may affect the transformation of color coordinate of the light emitted from the optical part 400. This will be described below with reference to FIG. 7.

Figure 7:
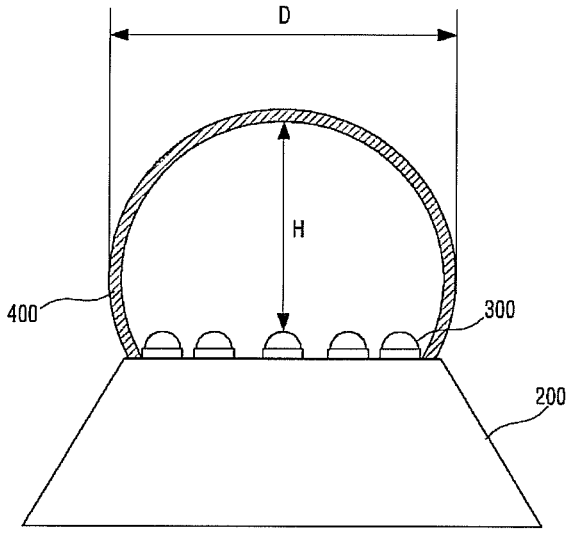
FIG. 7 shows an optical part, the light source unit and a mounting platform of the lighting device of FIG. 1.

FIG. 7 shows the optical part 400, the light source unit 300 and the mounting platform 200, all of which have been of FIG. 1. The distance "D" represents the diameter (or width) of the optical part 400, particularly, the diameter of the outer surface of the optical part 400. The distance "H" represents the maximum distance (maximum height) from the center of the light source unit 300 to the optical part 400, for example, the maximum distance from the center of the light source unit 300 to the inner surface of the optical part 400. Here, the center of the light source unit 300 corresponds to the center of the light emitting devices 330.

The distances "D" and "H" have a relationship that a ratio H/D is equal to or greater than 0.72 and less than and not equal to 1. When H/D is greater than or equal to 0.72 and less than 1, there is an advantage that there is little transformation of the color coordinate of the light emitted from the optical part 400. This will be described with reference to FIG. 8.

Figure 8:
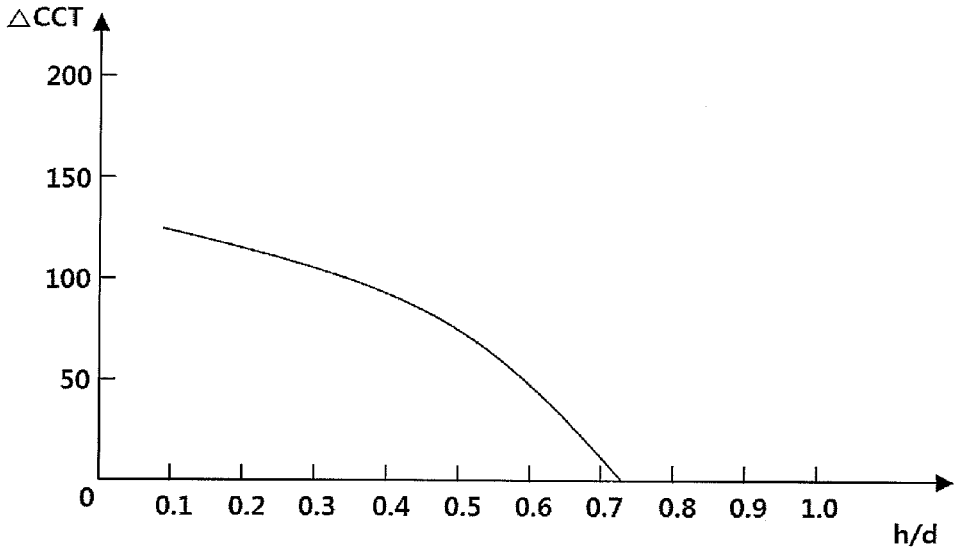
FIG. 8 is a graph showing an amount of color temperature variation (ΔCCT) of light emitted from the optical part with respect to a ratio H/D, wherein H and D are distances as illustrated in FIG. 7.

FIG. 8 is a graph showing an amount of color temperature variation (ΔCCT) of light emitted from the optical part 400 with respect to a ratio H/D, wherein H and D are distances as illustrated in FIG. 7. It can be found that the amount of color temperature variation increases as the ratio H/D decreases below about 0.72. When H/D is greater than or equal to about 0.72 and less than 1, it can be found that the amount of color temperature variation is 0.

Figure 9:
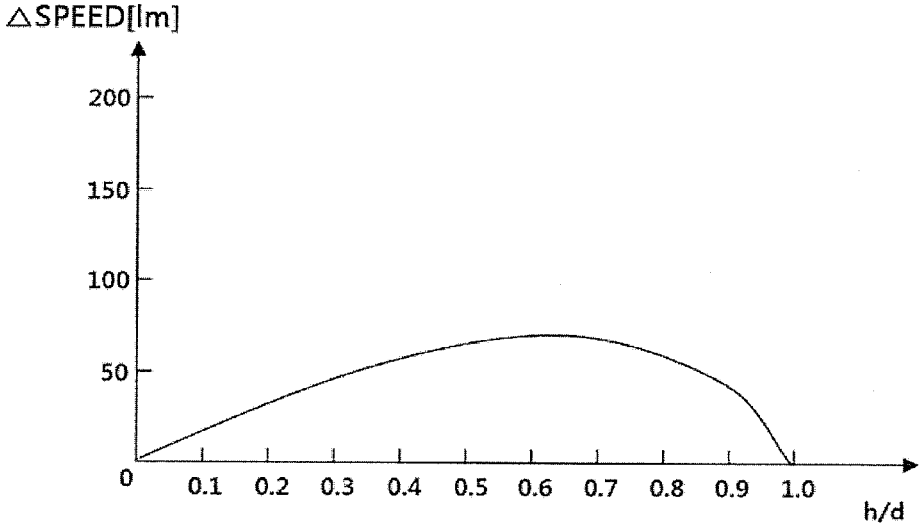
FIG. 9 is a graph showing an amount of speed variation (Δlm) of light emitted from the optical part in accordance with H/D, wherein H and D are distances as illustrated in FIG. 7.

FIG. 9 is a graph showing an amount of speed variation (Δlm) of light emitted from the optical part 400 with respect to the ratio H/D. It can be found that the closer H/D is to 1, the closer the amount of speed variation of light is to 0.

Referring back to FIG. 1, the cover 500 may be coupled to the heat sink 100 and disposed on the placement portion 110 of the heat sink 100. The cover 500 may be spaced apart from the optical part 400 at a predetermined interval.

The cover 500 may surround the placement portion 110 of the heat sink 100, the mounting platform 200 and the optical part 400. The light emitted from the cover 500 may have improved lateral light distribution. This can be obtained by disposing the mounting platform 200 in such a manner that the light source unit 300 is at or near the central portion of the cover 500.

The inner surface of the cover 500 may be coated with an opalescent pigment. The cover 500 may include a diffusion material in order to diffuse the light emitted from the optical part 400. Moreover, the cover 500 may be formed of glass. However, glass has disadvantages in increased weight as well as vulnerability to damage from external impact. Therefore, the cover 500 may be formed of any one of plastic, polypropylene (PP), polyethylene (PE), polycarbonate (PC), or another appropriate type of material. Here, the polycarbonate (PC) may provide improved light resistance, thermal resistance and impact strength properties.

The inner surface or the outer surface of the cover 500 may have a prescribed roughness. For example, the inner and outer surfaces may have a textured surface having a prescribed pattern or texture to vary the roughness. The surface roughness of the inner surface of the cover 500 may be greater than the surface roughness of the outer surface of the cover 500. In this case, when the light emitted from the optical part 400 is radiated to the inner surface of the cover 500 and is emitted outwardly, the light radiated to the inner surface of the cover 500 is sufficiently scattered and diffused and is emitted outwardly. Therefore, the light emitting property of the lighting device may be improved. The cover 500 may be formed through a blow molding process capable of increasing a light orientation angle.

The power source 600 may be received in the inner case 700 and received in the receiver 150 (recess) of the heat sink 100. The power source 600 may include a support plate and a plurality of parts mounted on the support plate. The plurality of the parts may include, for example, a DC converter converting AC power supply supplied by an external power supply into DC power supply, a driving chip controlling the driving of the light source unit 300 and an electrostatic discharge (ESD) protective device for protecting the light source unit 300. Other appropriate types of devices may also be included.

The power source 600 is supplied with an external electric power from the socket 800, generates an electric power for driving the light source unit 300 by using the supplied external electric power and transfers the generated electric power to the light source unit 300 by the use of a wire or the like.

The inner case 700 may include an upper portion receiving the power source 600 and a lower portion which is coupled to the socket 800. The upper portion of the inner case 700 may be received in the receiver 150 of the heat sink 100. The lower portion of the inner case 700 may have a screw thread/screw groove structure in order to be coupled to the socket 800.

The upper portion and the lower portion of the inner case 700 may be integrally formed of a plastic or resin based insulation material through which electricity does not flow. The inner case 700 may prevent electrical contact between the heat sink 100 and the power source 600 and may prevent electrical contact between the heat sink 100 and the socket 800.

The socket 800 is electrically connected to an external power source and is coupled to the lower portion of the inner case 700. The socket 800 may be coupled to the inner case 700 by a rotary coupling through the screw thread/screw groove structure. The socket 800 is electrically connected to the power source 600 through a wire and the like.

Figure 10:
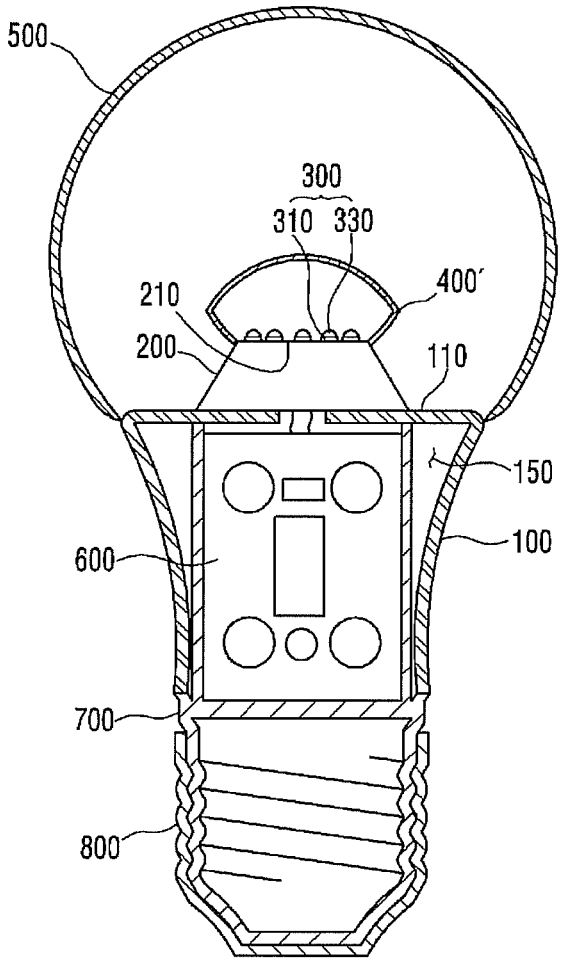
FIG. 10 is a cross-sectional view of a lighting device according to one embodiment.

FIG. 10 is a cross-sectional view of a lighting device according to one embodiment. The lighting device may include a heat sink 100, a mounting platform 200 (mounting surface), a light source unit 300, an optical part 400' (enclosure), a cover 500 (bulb), a power source 600, an inner case 700 and a socket 800.

Since the components except the optical part 400' are the same as those of the lighting device of FIG. 1, the following description will focus on the optical part 400' and descriptions of the other components will be omitted.

The optical part 400' of FIG. 10 has a shape that is different from that of the optical part 400 of FIG. 1. Since the features other than the shape of the optical part 400' of FIG. 10 are the same as those of the optical part 400 of FIG. 1, hereafter, only the shape of the optical part 400' of FIG. 10 will be described in detail.

Figure 11:
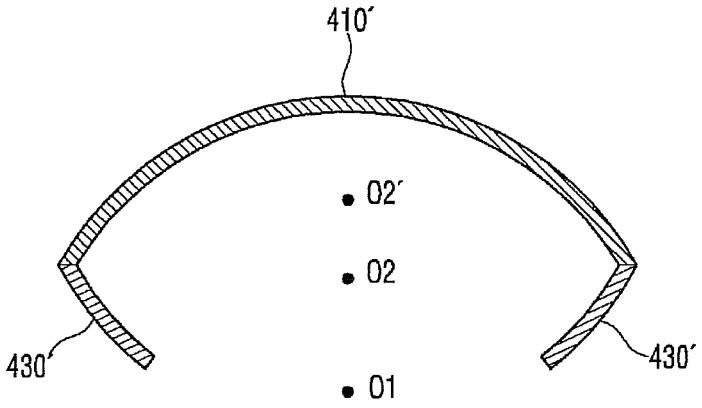
FIG. 11 is a cross-sectional view of an optical part of the lighting device of FIG. 10.

FIG. 11 is a cross-sectional view of the optical part 400' of FIG. 10. The optical part 400' may include an upper portion 410' and a lower portion 430' connected to the upper portion 410'. The upper portion 410' may be a portion of a first sphere having a first center "O1". The lower portion 430' may be a portion of a second sphere having second centers "(O2, O2')". Here, a first radius of the first sphere and a second radius of the second sphere may be the same as or different from each other. The positions of the second centers "(O2, O2')" may be varied based on the position of the light source.

The position of the first center "O1" of the first sphere and the positions of the second centers "(O2, O2')" of the second sphere may be different from each other. Specifically, the second centers "(O2, O2')" may be positioned over the first center "O1".

The center "O" of the light source unit 300 as illustrated in FIG. 2 may correspond to the first center "O1" of the first sphere. In this case, the second center of the second sphere may correspond to "O2". A distance from the first center "O1" to the second center "O2" may be less than the radius of the second sphere.

Meanwhile, the center "O" of the light source unit 300 as illustrated in FIG. 2 may be located between the first center "O1" of the first sphere and the second center "O2'" of the second sphere. In this case, a distance from the first center "O1" to the second center "O2'" may be greater than the radius of the second sphere. Also, a distance from the first center "O1" to the center "O" of the light source unit 300 of FIG. 2 may be the same as a value obtained by subtracting the radius of the second sphere from the radius of the first sphere.

The optical part 400' and the configuration of the upper portion 410' and the lower portion 430' and corresponding centers "O1", "O2", and "O2'" will be described in further detail with reference to FIGS. 12 to 17.

Figure 12:
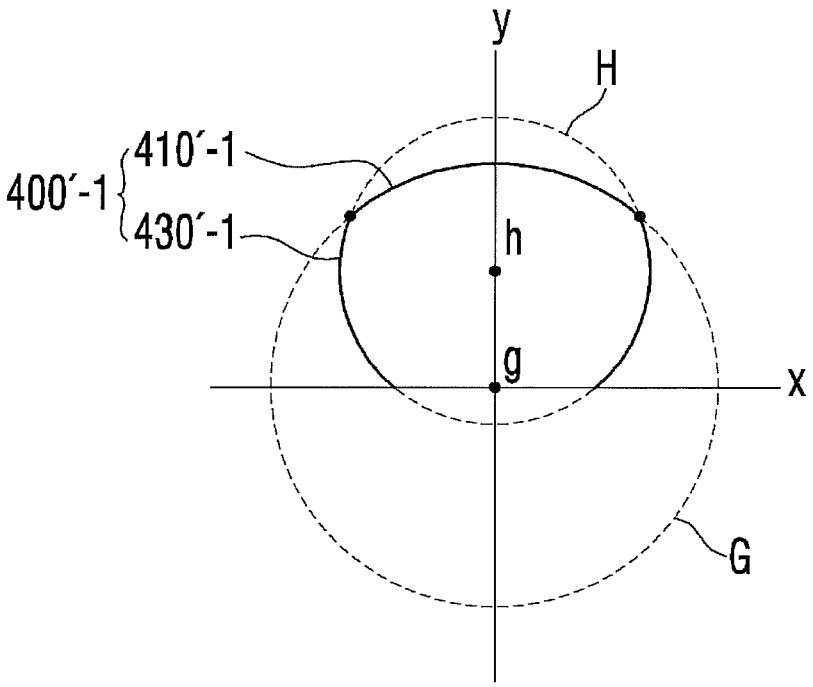
FIG. 12 is a graph that illustrates a shape of the optical part of FIG. 11 according to one embodiment.
Figure 13:
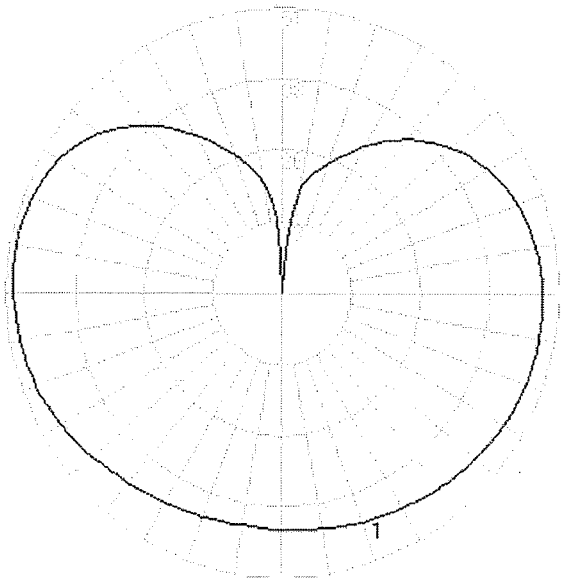
FIGS. 13 to 16 are light distribution charts associated with the optical part of FIG. 12, with respect to a ratio r/R, wherein r is a radius of a circle "H" and R is a radius of a circle "G" of FIG. 12.
Figure 14:
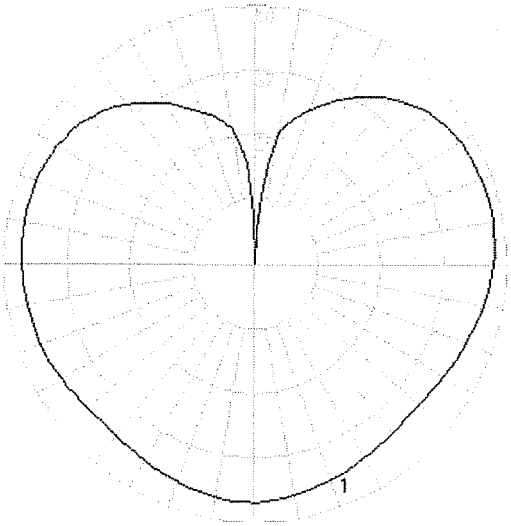
Figure 15:
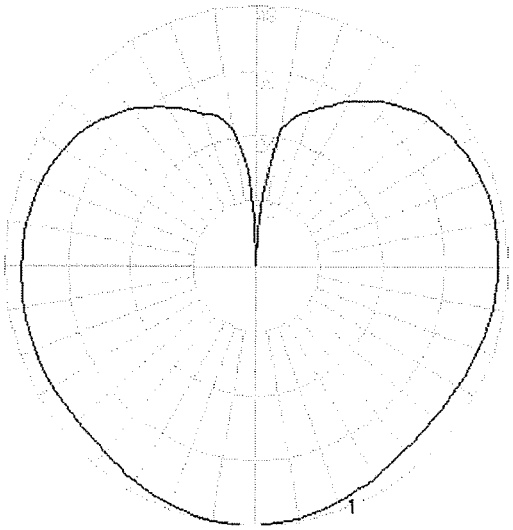
Figure 16:
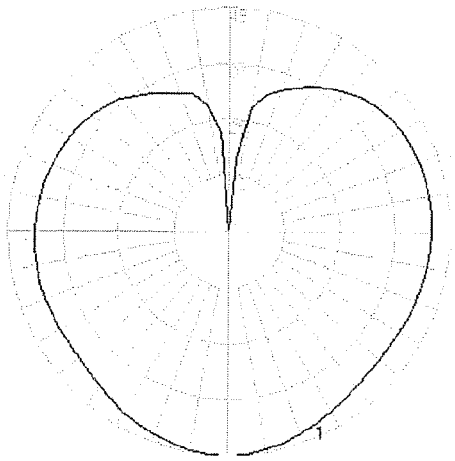
Figure 17:
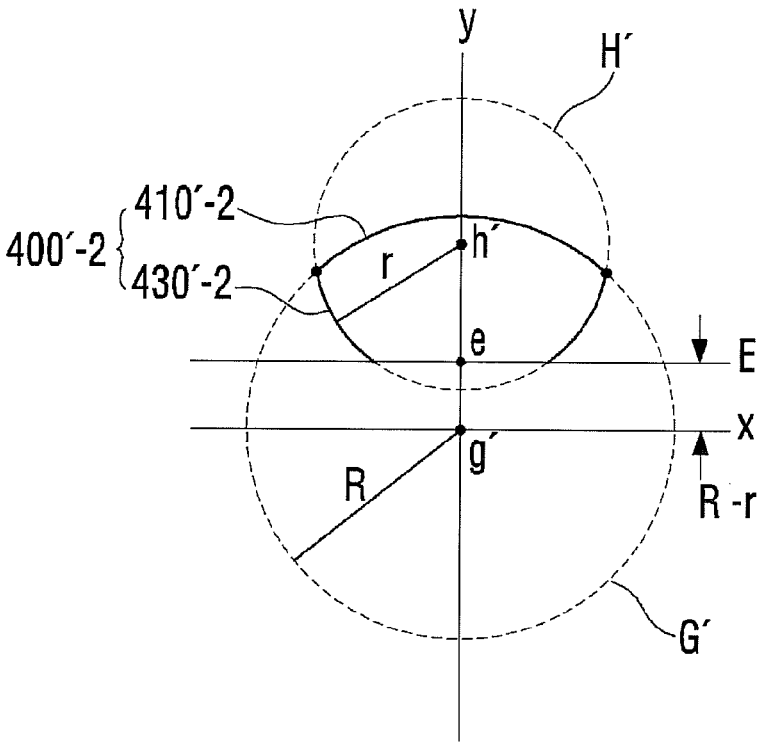
FIG. 17 is a graph that illustrates a shape of the optical part of FIG. 11 according to another embodiment.

FIG. 12 is a graph that illustrates a shape of an optical part according to a first embodiment. FIG. 17 is a graph that illustrates a shape of an optical part according to a second embodiment. In FIGS. 12 and 17, for convenience of description, the optical parts 400'-1 and 400'-2 are represented by a solid line and described by means of a circle in lieu of a sphere.

The optical part 400'-1 according to the first embodiment of FIG. 12 is designed by assuming that the light source unit 300 of FIG. 10 is positioned on an X-axis. Specifically, the center "O" of the light source unit 300 of FIG. 2 corresponds to a point "g" on the X-Y plane.

Referring to FIG. 12, the optical part 400'-1 may include an upper portion 410'-1 and a lower portion 430'-1. The upper portion 410'-1 and the lower portion 430'-1 may be connected to each other, and may be formed integrally or separately.

The upper portion 410'-1 is a portion of a circular arc of a circle "G". The circle "G" has a center point "g" and has a radius "R". Here, the point "g" is the center "O" of the light source unit 300 of FIG. 2. The radius "R" is a predetermined value which is equal to or larger than the radius "r" of a circle "H".

The lower portion 430'-1 is a portion of a circular arc of a circle "H". The circle "H" has a center point "h" and has a radius "r". Here, the point "h" may be located on a Y-axis and a distance from the point "h" to the point "g" may be less than the radius "r" of the circle "H". Accordingly, the point "h" may be located on the Y-axis in such a manner that the distance from the point "h" to the point "g" is less than the radius "r". The radius "r" may be a predetermined value.

A distance between two points formed by the circle "H" passing through the X-axis may be "A" as illustrated in FIG. 2. Therefore, the diameter "B" of the trace "P", which determines the positions of the light emitting devices 330, may be equal to or larger than 0.65 times as long as "A" and less than and not equal to 1 times as long as "A".

FIGS. 13 to 16 are light distribution charts of the lighting device of FIG. 10, in accordance with a ratio of a radius "r" of a circle "H" to a radius "R" of a circle "G" as illustrated in FIG. 12. In order to obtain the light distribution of FIGS. 13 to 16, the distance between the point "h" and the point "g" may be fixed at 4 mm. The radius "r" of the circle "H" may be fixed at 7 mm. The radius "R" of the circle "G" may be determined as a predetermined value between 6 mm and 10 mm. As illustrated in FIGS. 13 to 16, the lateral light distribution may be improved with the decrease in a ratio of the radius "r" to the radius "R" (r/R).

Referring to FIG. 17, the optical part 400'-2 according to the second embodiment is designed with the assumption that the light source unit 300 of FIG. 10 is not positioned on the X-axis. For example, the light source unit 300 may be positioned higher relative to the upper portion 410' than as illustrated in the previous embodiment of FIG. 12. The optical part 400'-2 includes an upper portion 410'-2 and a lower portion 430'-2. The upper portion 410'-2 and the lower portion 430'-2 may be connected to each other, either integrally formed or separately connected.

The upper portion 410'-2 may be a portion of a circular arc of a circle "G'". The circle "G'" has a center point "g'" and has a radius "R'". Here, the point "g'" is a reference point. The radius "R'" is a predetermined value which is equal to or larger than the radius "r'" of a circle "H'".

The lower portion 430'-2 is a portion of a circular arc of a circle "H'". The circle "H'" has a center point "h'" and has a radius "r'". Here, the point "h'" may be located on the Y-axis and a distance from the point "h'" to the point "g'" may be greater than the radius "r'". Accordingly, the point "h'" may be located on the Y-axis in such a manner that the distance from the point "h'" to the point "g'" is greater than the radius "r'". The radius "r'" is a predetermined value.

A point "e" corresponds to the center "O" of the light source unit 300 of FIG. 2. The point "e" may be located apart from the point "g'" at a distance of R'-r'. Therefore, the light source unit 300 of FIG. 2 may be positioned through the point "e" and on the E-axis, parallel with the X-axis.

A distance between two points formed by the circle "H'" passing through the E-axis may be "A" of FIG. 2. Therefore, the diameter "B" of the trace "P", which determines the positions of the light emitting devices 330, may be equal to or larger than 0.65 times as long as "A" and less than and not equal to 1 times as long as "A".

Like the lighting device including the optical part 400'-1 of FIG. 12, the lighting device including the optical part 400'-2 of FIG. 17 has an advantage of an improved lateral light distribution.

Figure 18:
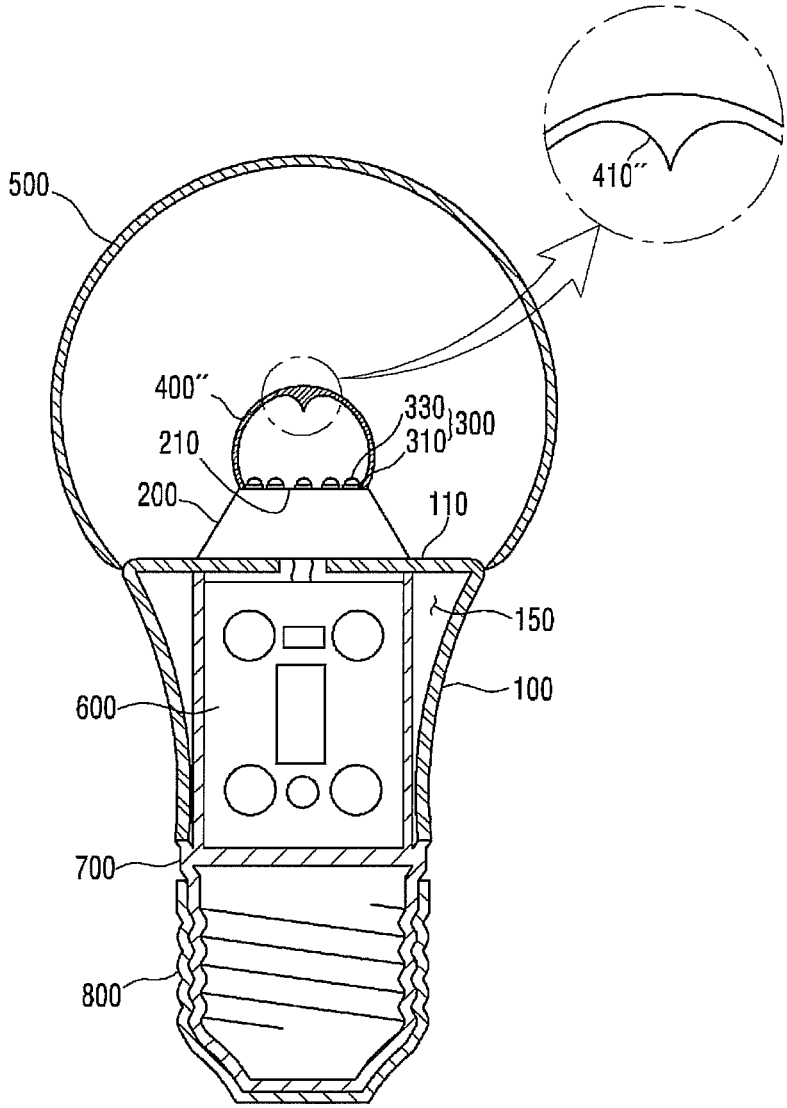
FIG. 18 is a cross-sectional view of a lighting device according to one embodiment.

FIG. 18 is a cross-sectional view of a lighting device according to one embodiment. The lighting device in this embodiment may include a heat sink 100, a mounting platform 200 (mounting surface), a light source unit 300, an optical part 400" (enclosure), a cover 500 (bulb), a power source 600, an inner case 700 and a socket 800.

Since the components except the optical part 400" are the same as those of the lighting device of FIG. 1, the following description will focus on the optical part 400" and descriptions of the other components will be omitted.

The optical part 400" of FIG. 18 has a shape which is different from that of the optical part 400 of FIG. 1. Since the features other than the shape of the optical part 400" of FIG. 18 are the same as those of the optical part 400 of FIG. 1, hereafter, only the shape of the optical part 400" of FIG. 18 will be described in detail.

Referring to FIG. 18, the optical part 400" includes an optical surface 410" that reflects the light emitted from the light source unit 300. The optical surface 410" may be a portion of the inner surface of the optical part 400" or may be disposed on a portion of the inner surface of the optical part 400". For example, the optical surface 410" may be integrally formed on the inner surface or may be a separate component that is mounted to the inner surface. The optical surface 410" may be positioned over a center of the light source unit 300.

The optical surface 410" may have a shape that protrudes from the inner surface of the optical part 400" toward the center of the light source unit 300. For example, the optical surface 410" may be a protrusion and may have a conical shape/surface. The conical surface may refer to the lateral surface of the cone except the bottom surface of the cone. In the present specification, the conical surface includes not only a geometrically perfect conical surface (e.g., linear side surface) but also a conical surface that is curved inward or outward. For example, the conical surface may have a concave shape, as shown in FIG. 18, or a convex shape.

The optical surface 410" may reflect the light emitted from the light source unit 300 in a lateral direction. Therefore, the lateral light distribution of the lighting device may be improved. Further, the optical surface 410" may not only reflect the light emitted from the light source unit 300 but also transmit a part of the light therethrough (e.g., translucent). Since the optical surface 410" can transmit a portion of the light, a dark region (e.g., low light distribution region) at an upper portion of the cover 500 may be prevented.

The optical surface 410" may be curved. The curved surface of the optical surface 410" may be determined by predetermined numerical formulas. Hereafter, this will be described in detail with reference to FIGS. 19 and 20.

Figure 19:
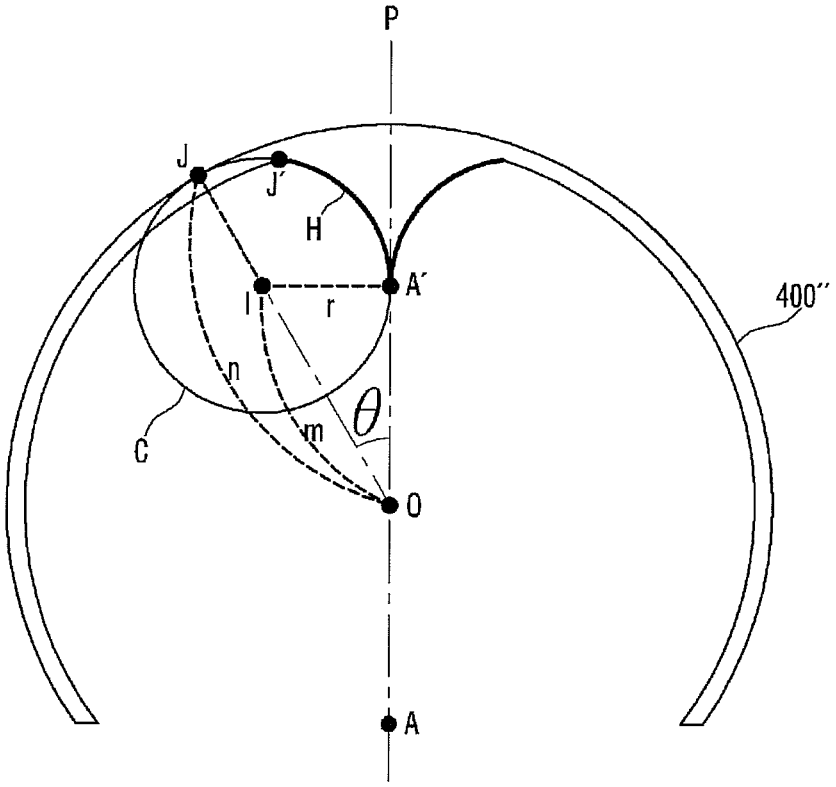
FIG. 19 is a cross-sectional view of an optical part of the lighting device of FIG. 18.

FIG. 19 is a cross-sectional view of the optical part 400" of FIG. 18. The shape of optical surface 410" of FIG. 18 may be determined based on a set of curves. Each of the curves correspond to a circular arc of each of a plurality of circles. Hereafter, one circular arc among the plurality of the circular arcs will be calculated from one circle.

Referring to FIG. 19, "P" represents a reference axis passing through the center "O" of the optical part 400" and the center "A" of the light source unit 300. Here, the center "A" of the light source unit 300 may refer to the center of the plurality of the light emitting devices 330 on the mounting surface. "A'" represents a point symmetrical to point "A" with respect to the center "O" of the optical part 400". Angle "θ" represents an acute angle ($0°<\theta<90°$). "J" represents a first intersection point formed through the intersection of the outer surface of the optical part 400" and a segment (or line) forming an acute angle with the reference axis "P". A circle "C" has a center "I" and a radius "r" and contacts the reference axis "P".

When a segment (line) connecting the center "O" of the optical part 400" with the first intersection point "J" is equally divided into n numbers of segments, the center "I" of the circle "C" corresponds to the $m^{th}$ point from the center "O" of the optical part 400". Here, "m" and "n" are natural numbers and "m" is less than "n".

The radius "r" of the circle "C" corresponds to a distance from the center "I" of the circle "C" to the symmetrical point "A'". The circle "C" is determined by the center "I" and the radius "r".

After the circle "C" is determined, the optical surface 410" as illustrated in FIG. 18 may be determined to be a circular arc "H" of the circle "C". The circular arc "H" may be a curve connecting a point "j'" with the point "A'" in circle "C". The point j' may be formed through the intersection of the circle "C" and the inner surface of the optical part 400". Here, if two points are formed through the intersection of the circle "C" and the inner surface of the optical part 400", the point which is closer to the reference axis "P" than the other may be determined to be the point "j". The optical surface 410" may be formed by rotating the circular arc "H" with respect to the reference axis "P". For example, the optical surface 410" may be symmetrically centered along the reference axis "P".

Figure 20:
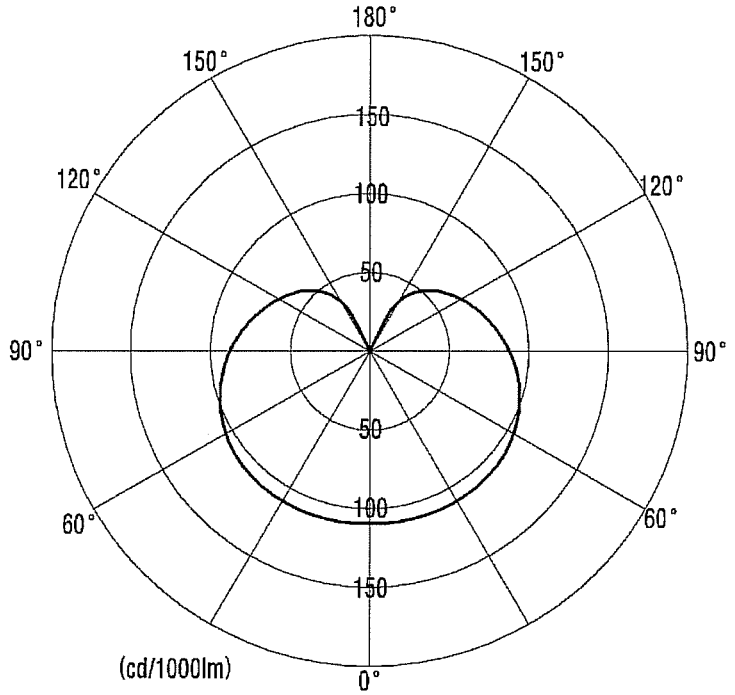
FIG. 20 is a light distribution chart of light emitted from a light source unit of the lighting device of FIG. 18.
Figure 21:
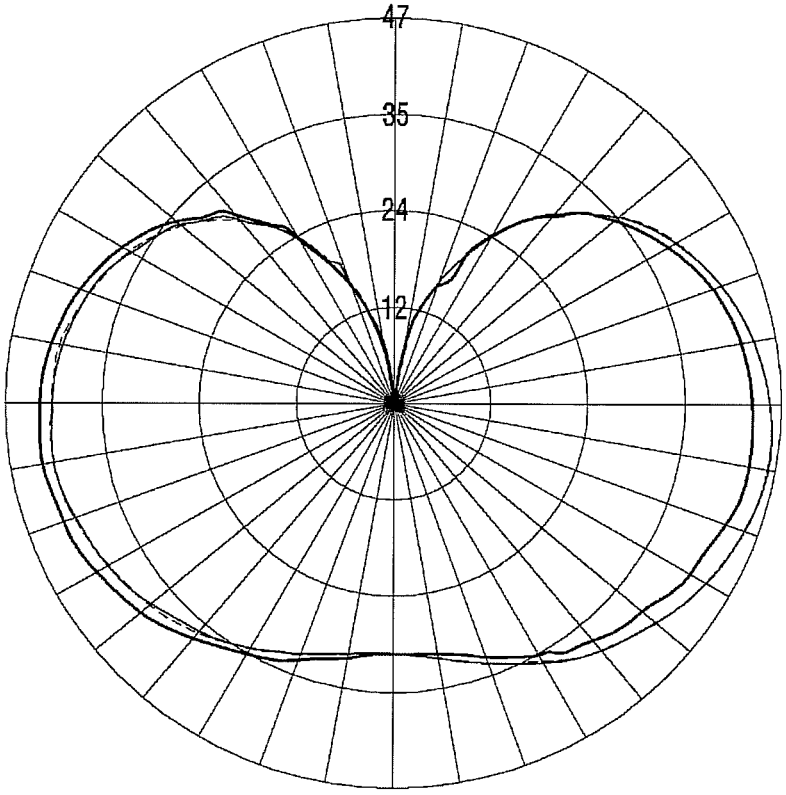
FIG. 21 is a light distribution chart of light emitted from an optical part of the lighting device of FIG. 18.

FIG. 20 is a light distribution chart of light emitted from the light source unit 300 of the lighting device of FIG. 18. FIG. 21 is a light distribution chart of light emitted from the optical part 400" of the lighting device of FIG. 18. These graphs illustrate the improved light distribution of the light emitted from the optical part 400" in the lateral direction. The emitted light is distributed more evenly, particularly with respect to regions near the heat sink (bottom) of the lighting device, i.e., 135° to 180° and 180° to 135°. This can be inferred by the optical surface 410" of the optical part 400".

FIGS. 22 to 25 are light distribution charts that illustrate light characteristics of a lighting device corresponding to prescribed shapes of the optical part of FIG. 18. FIGS. 22 to 25 illustrate light distribution with respect to a ratio m/n as illustrated in FIG. 19.

In the light distribution charts of FIGS. 22 to 25, it is premised that the radius of the optical part 400" is 10 mm, θ is 30° and m is 20. Here, simply for ease of description, the meaning that the radius of the optical part 400" is 10 mm assumes that a distance between the outer surface and the inner surface of the optical part 400", or the thickness of the optical part 400", is 0.

Figure 22:
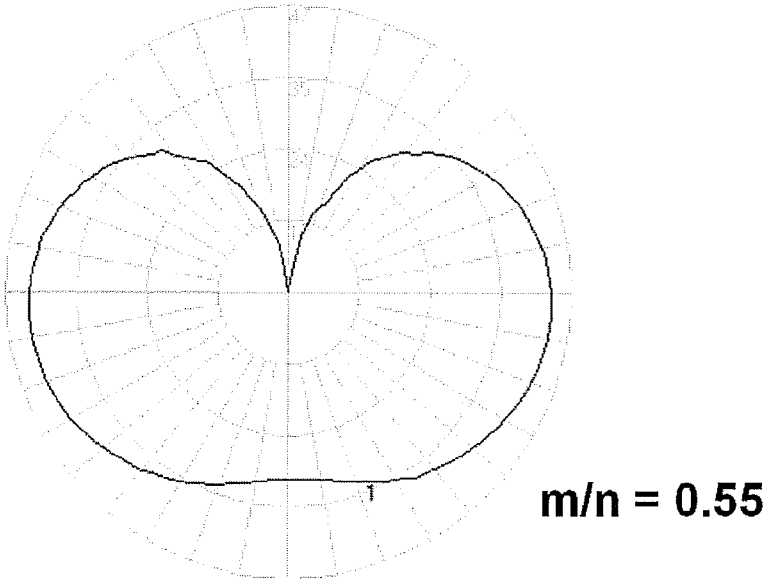
FIGS. 22 to 25 are light distribution charts that illustrate light characteristics of a lighting device corresponding to prescribed shapes of the optical part of FIG. 18.
Figure 23:
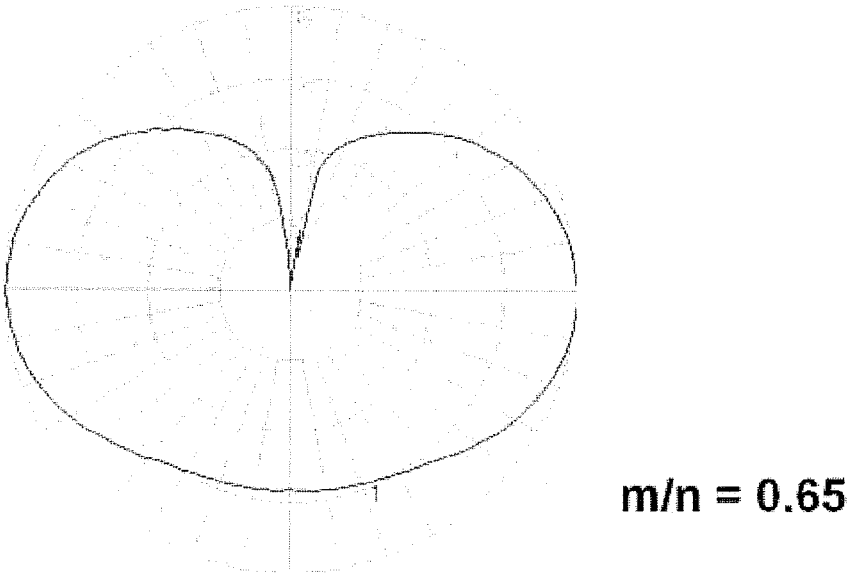
Figure 24:
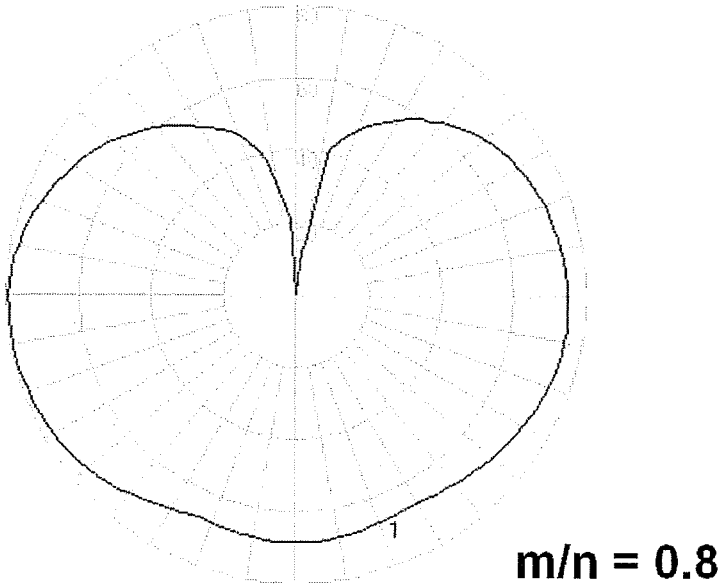
Figure 25:
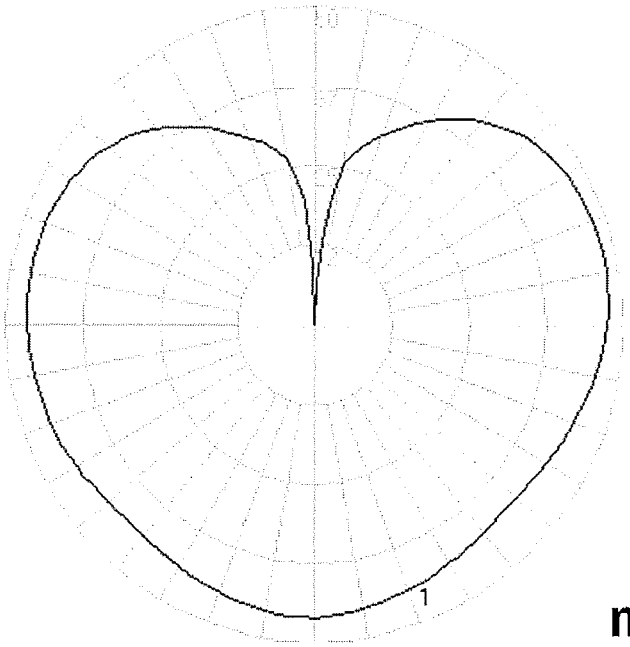

FIG. 22 is a light distribution chart when the ratio m/n is 0.55. FIG. 23 is a light distribution chart when m/n is 0.65. FIG. 24 is a light distribution chart when m/n is 0.8. FIG. 25 is a light distribution chart when m/n is 0.9. Referring to FIGS. 22 to 25, not only the lateral light distribution, but also a front light distribution, may be improved with the increase of the value of the ratio m/n. Here, the front light distribution refers to the intensity of light which is emitted through the upper portion of the cover 500 of FIG. 18.

Figure 26:
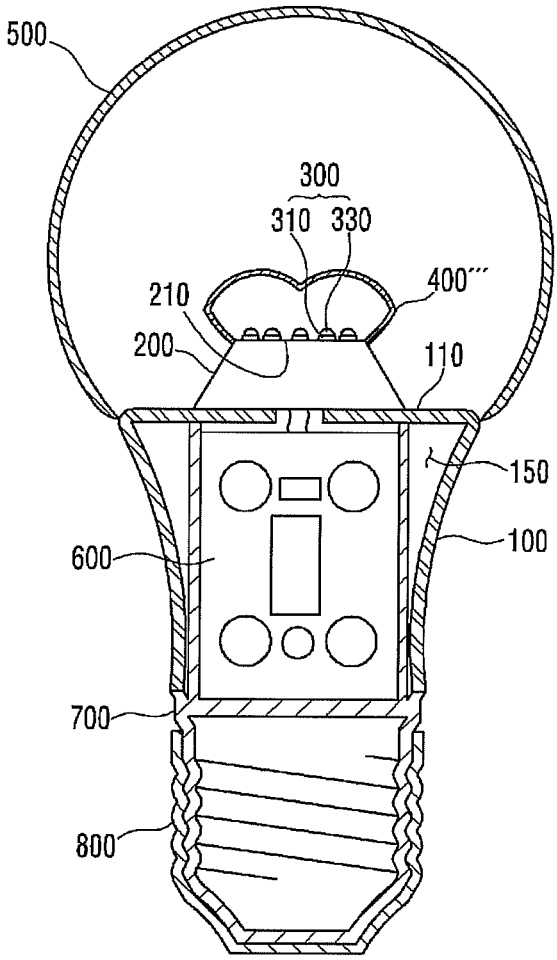
FIG. 26 is a cross-sectional view of a lighting device according to one embodiment.

FIG. 26 is a cross-sectional view of a lighting device according to one embodiment. The lighting device of this embodiment may include a heat sink 100, a mounting platform 200 (mounting surface), a light source unit 300, an optical part 400''' (enclosure), a cover 500 (bulb), a power source 600, an inner case 700 and a socket 800.

Since the components except the optical part 400''' are the same as those of the lighting device of FIG. 1, the following description will focus on the optical part 400''' and descriptions of the other components will be omitted.

The optical part 400''' of FIG. 26 has a shape different from that of the optical part 400 of FIG. 1. Since the features other than the shape of the optical part 400''' of FIG. 26 are the same as those of the optical part 400 of FIG. 1, hereafter, only the shape of the optical part 400''' of FIG. 26 will be described in detail.

The optical part 400''' may have a predetermined relationship with the light emitting device 330. Specifically, the structure and shape of the optical part 400''' may be changed according to the number of the light emitting devices 330. This will be described in detail with reference to FIGS. 27 to 28.

Figure 27:
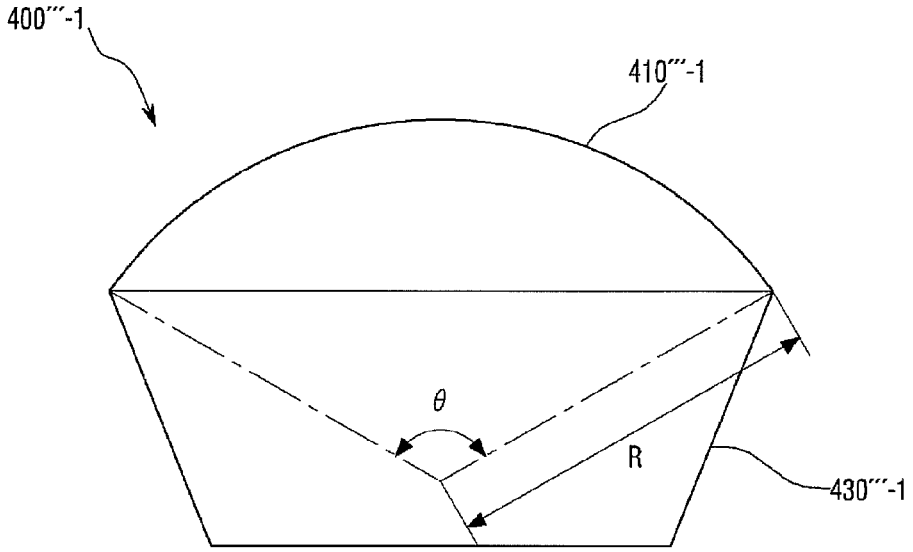
FIG. 27 is a front view of an optical part corresponding to a light emitting device.
Figure 28:
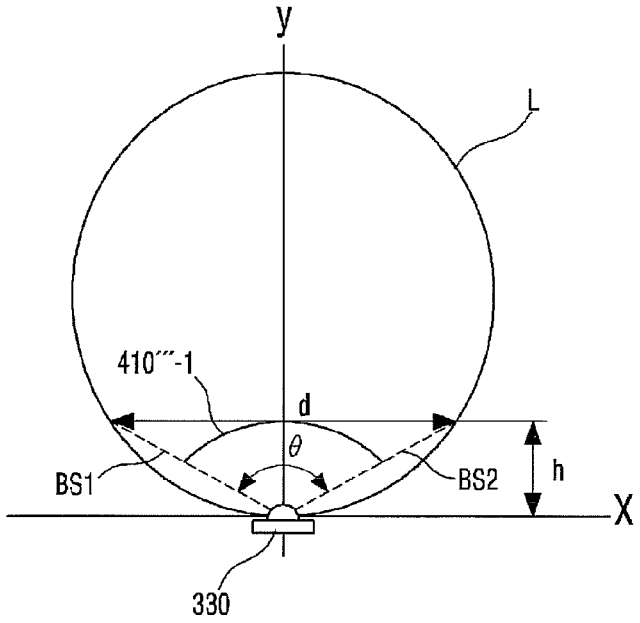
FIG. 28 is a view that illustrates a relationship between the light emitting device and the optical part of FIG. 27.

FIG. 27 is a front view of an optical part corresponding to a light emitting device. FIG. 28 is a view that illustrates a relationship between the light emitting device and the corresponding optical part of FIG. 27. The structure of an optical part 400'''-1 of FIG. 27 corresponds to one light emitting device 330 among the plurality of the light emitting devices 330 as described with reference to FIG. 26. For reference, the structure of the optical part 400''' of FIG. 26 depends on the number and positions of the plurality of the light emitting devices 330. This will be described later.

In FIG. 27, the optical part 400'''-1 corresponding to one light emitting device 330 may include a first optical part 410'''-1 and a second optical part 430'''-1. The first optical part 410'''-1 may be a portion of a hollow sphere. The second optical part 430'''-1 supports the first optical part 410'''-1.

The first optical part 410'''-1 may be a portion of a sphere having a radius "R". An angle between two segments connected respectively to both ends of the first optical part 410'''-1 is the same as the beam angle of the light emitting device 330. The second optical part 430'''-1 supports the first optical part 410'''-1 such that the first optical part 410'''-1 is arranged on and apart from the light emitting device 330 at an interval. The second optical part 430'''-1 may also be disposed to surround the light emitting device 330.

Here, the second optical part 430'''-1 may include an upper portion (upper end) and a lower portion (lower end). The upper portion of the second optical part 430'''-1 may be coupled to the first optical part 410'''-1. The lower portion of the second optical part 430'''-1 may be coupled to the mounting platform 200 of FIG. 26. The second optical part 430'''-1 may be integrally formed with the first optical part 410'''-1 or may be separately formed and coupled to the first optical part 410'''-1 by using adhesives or the like.

A method for designing the first optical part 410'''-1 of FIG. 27 will be described with reference to FIG. 28. In FIG. 28, simply for convenience of description, the first optical part 410'''-1 of FIG. 27 is represented by a solid line and is illustrated as being disposed on an X-Y plane. The light emitting device 330 may be disposed on the origin of the X-Y plane. Here, the first optical part 410'''-1 shown on the X-Y plane is represented by a curve. The curve represents the curved surface of the first optical part 410'''-1 of FIG. 27. Moreover, the solid line representing the first optical part 410'''-1 may represent any one of the outer surface or inner surface of the first optical part 410'''-1 of FIG. 27.

In description of the method for designing the first optical part 410'''-1, it is assumed that two values are determined in advance. The two values are 1) beam angle "θ" (angular range of light distribution) of the light emitting device 330 and 2) a distance "h" from the light emitting device 330 to the top of the first optical part 410'''-1. Hereafter, specifically, the first optical part 410'''-1 can be designed by the following process.

Two intersection points are calculated, which may be formed through the intersection of a straight line which is parallel with an X-axis and passes through a point (0, h) and beam angle lines BS1 and BS2 of the light emitting device 330. An area of a virtual circle, having a diameter equal to distance "d" between the two intersection points, is calculated.

Then, the radius "R" of the first optical part 410'''-1 of FIG. 27 is calculated. The radius "R" is a value when the area "A" of the circle is the same as the surface area "B" of the first optical part 410'''-1. For example, by setting the surface area of the first optical part 410'''-1 to be equal to the area "A" of the circle, radius "R" may be determined. After the radius "R" of the first optical part 410'''-1 is calculated, the first optical part 410'''-1 can be designed.

In summary, the structure of the first optical part 410'''-1 may be determined based on the beam angle of the light emitting device 330 and the height or distance between the light emitting device 330 and the first optical part 410'''-1. The shape of the optical part 400''' of FIG. 26 may be determined in the same manner as that of the first optical part 410'''-1 of FIG. 27. Due to the number of the light emitting devices 330, the structure of the optical part 400''' of FIG. 26 may be different from the structure of the first optical part 410'''-1 of FIG. 27. The structure of the optical part 400''' of FIG. 26 will be described in detail with reference to FIGS. 29 and 30.

Figure 29:
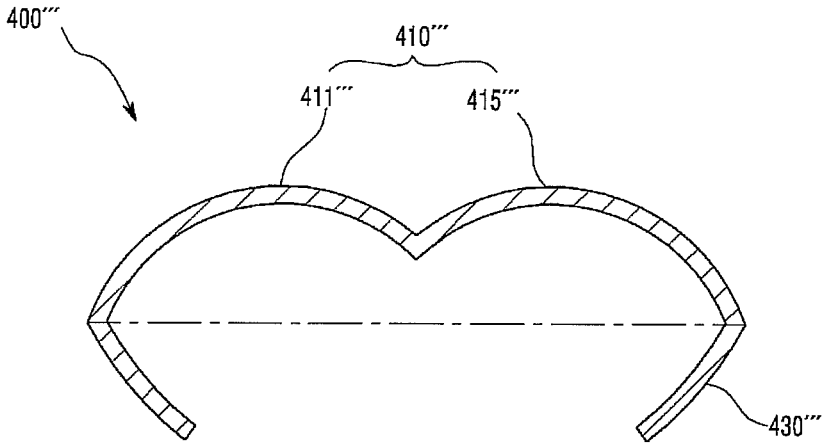
FIG. 29 is a cross-sectional view of the optical part of FIG. 26.

FIG. 29 is a cross-sectional view of the optical part 400''' of FIG. 26. The optical part 400''' includes a first optical part 410''' (first region of the enclosure) and a second optical part 430''' (second region of the enclosure). The first optical part 410''' may include portions 411''' and 415''' (sub-regions) of a hollow sphere.

The number of the portions 411''' and 415''' may be the same as that of the light emitting devices 330 of FIG. 26. That is, the portions 411''' and 415''' may one-to-one correspond to the light emitting devices 330. For example, each portion or sub-region that corresponds to a light emitting device 330 may be positioned directly over that light emitting device 330.

All of the portions 411''' and 415''' may have the same shape or may have different shapes from each other. When the light emitting devices 330 of FIG. 27 are the same kinds of products, the portions 411''' and 415''' have the same shape. The portions 411''' and 415''' may be connected to each other. Here, the portions 411''' and 415''' may be integrally formed with each other.

The first optical part 410''' may be disposed on the second optical part 430'''. For example, the first optical part 410''' may be connected to the upper portion (or upper end) of the second optical part 430'''. The first optical part 410''' may be integrally formed with the second optical part 430''' or may be connected to the second optical part 430''' by using adhesiveness and the like.

The second optical part 430''' may be disposed under the first optical part 410'''. The second optical part 430''' supports the first optical part 410''' such that the first optical part 410''' is arranged on and apart at an interval from the light emitting devices 330 of FIG. 27. Here, the second optical part 430''' may be designated as a "support member" supporting the first optical part 410'''.

The second optical part 430''' may include an upper portion (upper end) and a lower portion (lower end). The upper portion may be connected to the portions 411''' and 415''' of the first optical part 410'''. The lower portion may be coupled to the mounting platform 200 of FIG. 26.

The inner and outer surfaces of the second optical part 430''' may be curved or may be flat. For example, the second optical part 430''' may have a prescribed curvature or may be linear.

Figure 30:
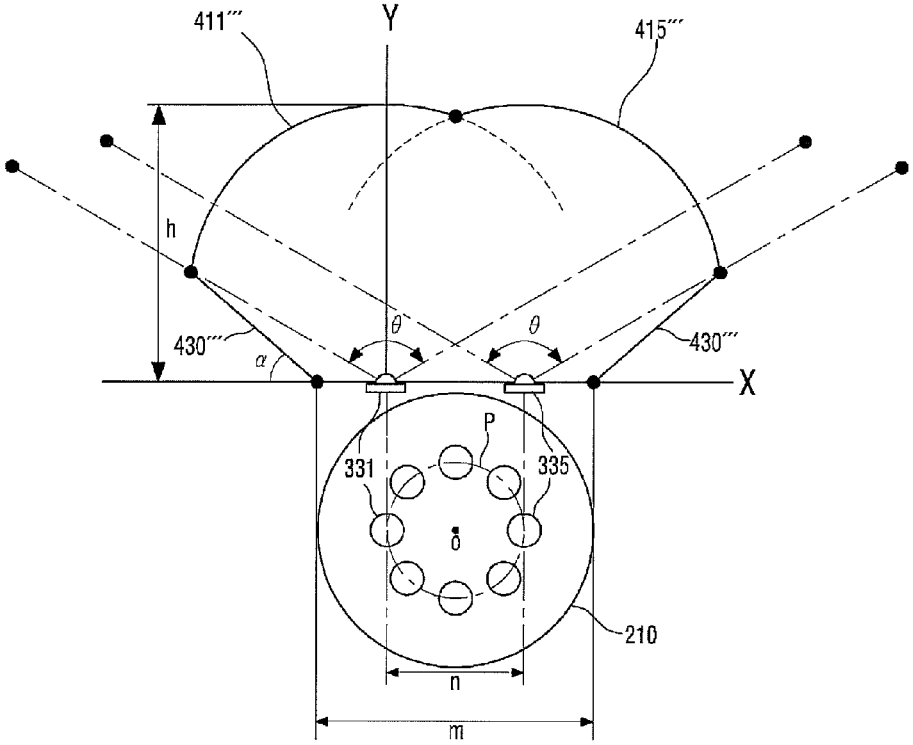
FIG. 30 is a view that illustrates a relationship between a light emitting unit and an optical part of FIG. 29.

FIG. 30 is a view that illustrates a relationship between a light emitting unit and the optical part of FIG. 29. In FIG. 30, simply for convenience of description, the first and the second optical parts 410''' and 430''' of FIG. 29 are disposed on the X-Y plane. A first light emitting device 331 may be located on the origin of the X-Y plane. A fifth light emitting device 335 may be located on the X-axis, separated from the first light emitting device 331 by a distance "n", e.g., from the origin of the X-Y plane. The first and the second optical parts 410''' and 430''' are represented by solid lines in FIG. 30.

Here, the first optical part 410''' shown on the X-Y plane is represented by a curve. The curve represents the curved surface of the first optical part 410''' of FIG. 29. The solid line representing the first and the second optical parts 410''' and 430''' may represent any one of the outer surfaces or inner surfaces of the first and the second optical parts 410''' and 430''' of FIG. 29. Referring to FIG. 30, a first portion 411''' of the first optical part 410''' corresponds to the first light emitting device 331 and a second portion 415''' corresponds to the fifth light emitting device 335.

The shape and configuration of the first and the second portions 411''' and 415''' may be determined separately using the process previously described in detailed with respect to FIGS. 27 and 28. In other words, the first portion 411''' may be designed using the beam angle "θ" for the first light emitting device 331 and a distance "h" between the first light emitting device 331 and the first portion 411'''. The second portion 415''' may be designed using a beam angle "θ" for the fifth light emitting device 335 and a distance "h" between the fifth light emitting device 335 and the second portion 415'''. When the first and the fifth light emitting devices 331 and 335 are the same kinds of products, the first and the fifth light emitting devices 331 and 335 may have the same shape.

The second optical part 430''' may be designed to be connected to the end of the first optical part 410'''. An angle "α" formed by the second optical part 430''' and the X-axis may be greater than (180-θ)/2 and less than 180°. Here, the "θ" is the beam angle of the light emitting device 330.

The diameter "m" of the lower portion of the second optical part 430''' may be greater than the diameter of the trace "P" for the light emitting devices 330. The distance "h" may have a predetermined relationship with the diameter "m" of the lower portion of the second optical part 430'''. Here, the distance or width "m" may be the diameter of the placement portion 210 of the mounting platform 200 of FIG. 26 or the diameter of a substrate on which the plurality of the light emitting devices 330 are disposed.

Figure 31:
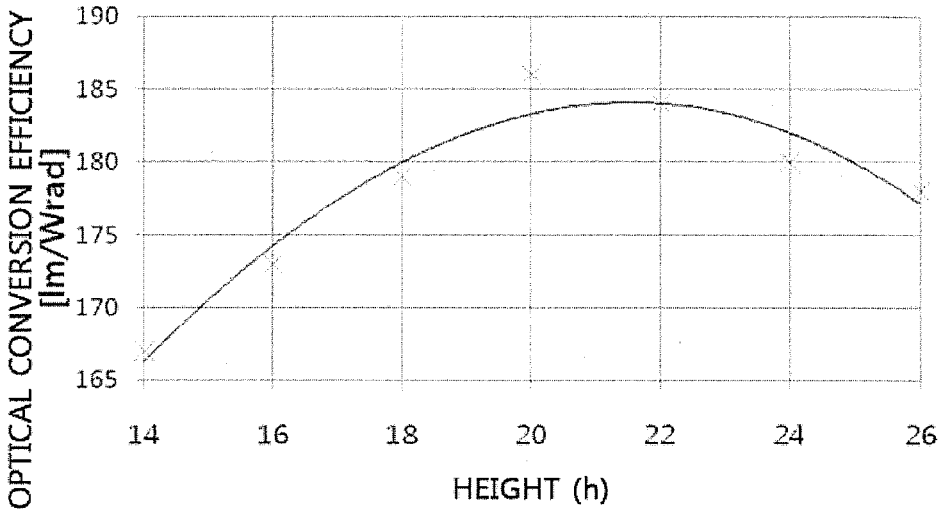
FIG. 31 is a graph showing optical conversion efficiency with respect to a height h of the optical part as illustrated in FIG. 30.

FIG. 31 is a graph showing optical conversion efficiency with respect to a height "h" of the optical part 400''' with respect to a height "h" of the optical part as illustrated in FIG. 30. FIG. 31 shows an experimental graph showing the optical conversion efficiency of the optical part 400''' in accordance with the variation of "h" under the state where "m" and "n" have been set to predetermined values. The width "m" is set to 21 mm and distance "n" is set to 10 mm.

Figure 32:
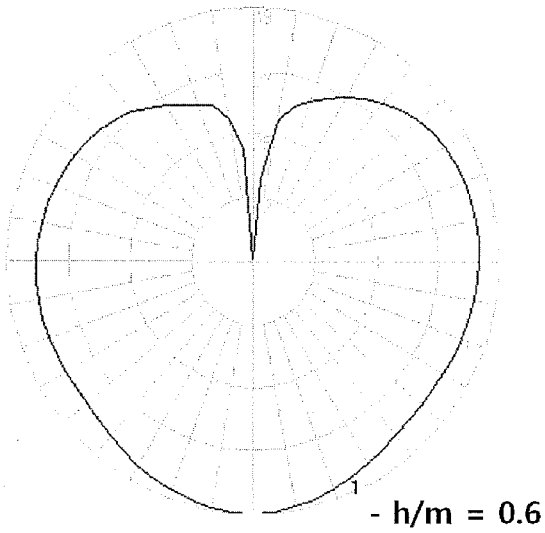
FIGS. 32 to 35 are light distribution charts that illustrate light characteristics of a lighting device corresponding to prescribed shapes of the optical part of FIG. 29.
Figure 33:
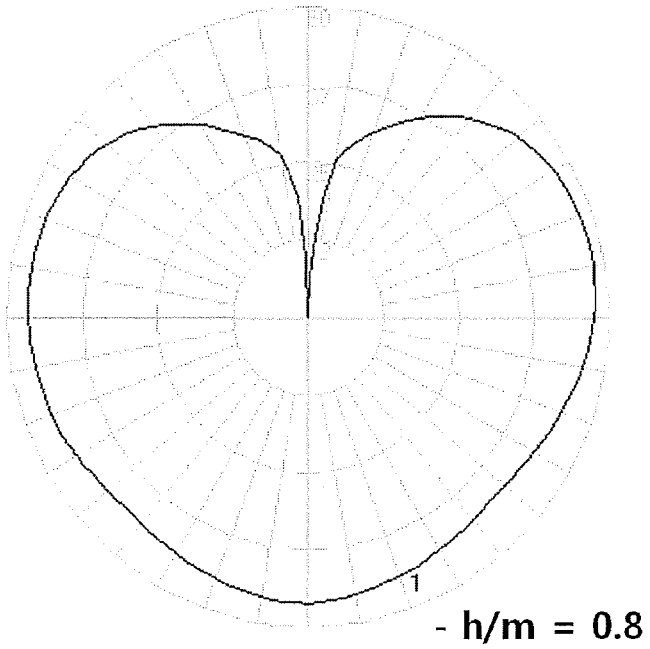
Figure 34:
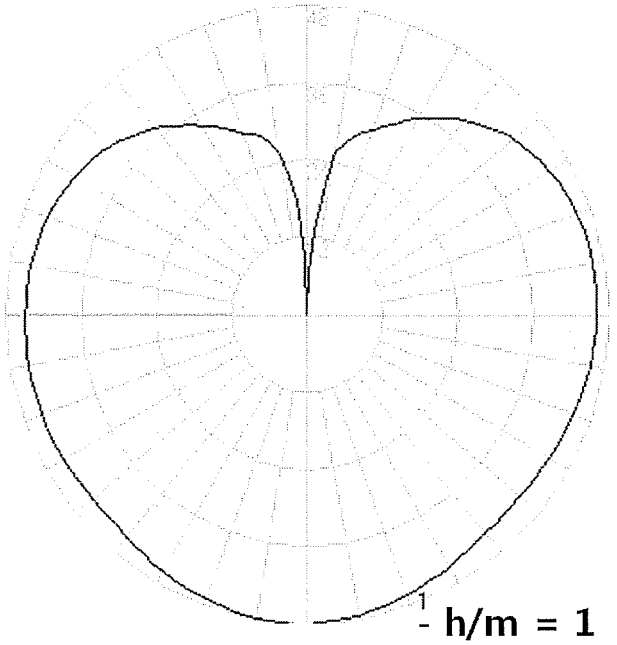
Figure 35:
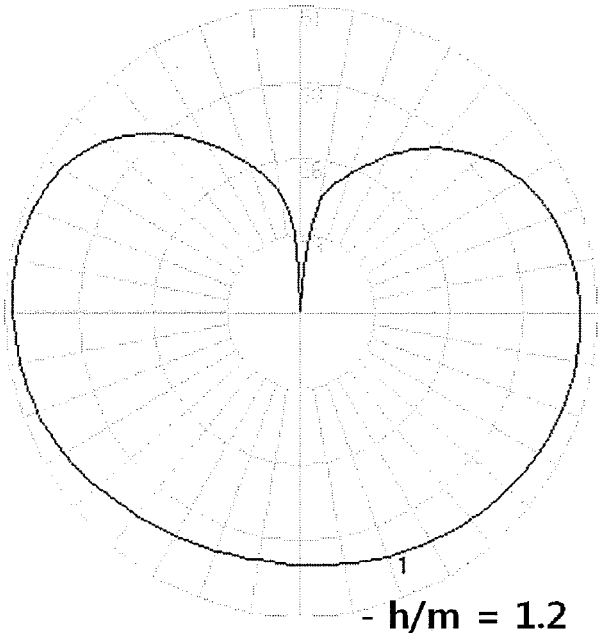

FIGS. 32 to 35 are light distribution charts that illustrate light characteristics of a lighting device corresponding to prescribed shapes of the optical part of FIG. 29. FIG. 32 is a light distribution chart of the lighting device when a ratio of "h" to "m" (h/m) is 0.6. FIG. 33 is a light distribution chart of the lighting device when h/m is 0.8. FIG. 34 is a light distribution chart of the lighting device when h/m is 1.0. FIG. 35 is a light distribution chart of the lighting device when h/m is 1.2.

FIGS. 31 and 32 illustrate that the lateral light distribution is improved and the optical conversion efficiency is high in the range where the ratio "h/m" is equal to or greater than 0.8 and equal to or less than 1.2. Accordingly, it is possible to obtain the desired lateral light distribution by appropriately adjusting the value of the ratio "h/m".

As broadly described and embodied herein, a lighting device may include a heat sink, a mounting surface provided a prescribed distance over the heat sink, a plurality of light emitting diodes provided on the mounting surface, the plurality of light emitting diodes being positioned a prescribed distance from a point on the mounting surface, an enclosure having a prescribed shape provided over the mounting surface and the plurality of light emitting diodes, the enclosure including luminescent material such that a wavelength of light emitted by the enclosure is different from a wavelength of light emitted by the plurality of light emitting diodes, and a bulb provided over the heat sink to surround the enclosure.

A ratio of the prescribed distance from the point to the light emitting diodes to a distance from the point to an edge of the mounting surface may be greater than or equal to 0.65 and less than 1.0. A ratio of a maximum distance from the point on the mounting surface to the enclosure to a width of the enclosure may be greater than 0.72 and less than 1. The point may be positioned at a center of the mounting surface and the plurality of light emitting diodes are not positioned at the center of the mounting surface.

The plurality of light emitting diodes may be positioned in a circular or oval pattern around the point on the mounting surface and the point is positioned at a center of the plurality of light emitting diodes. The enclosure may have an upper region and a lower region, the upper region having a curvature different than the lower region.

Moreover, the enclosure may have a spherical shape. Here, the enclosure may include a protrusion that protrudes toward the light emitting diodes from an upper inner surface of the enclosure. The protrusion may have a conical shape and a lateral surface of the protrusion is curved to have concave or convex shape. The protrusion may be configured to allow at least a portion of light emitted from the light emitting diodes to be transmitted therethrough. The protrusion may have a conical shape having a prescribed curvature and positioned symmetrically along a central vertical axis of the enclosure, and wherein a radius of curvature of the protrusion is less than a radius of curvature of the enclosure.

The enclosure may have an outer surface, an inner surface and an optical surface that reflects light from the plurality of the light emitting devices, the optical surface having a prescribed curvature that corresponds to a portion of a virtual circle. A center of the circle may be positioned at an mth section along a line that extends from a center of the enclosure to the outer surface, the line forming an acute angle with a reference axis and equally divided into n numbers of sections, "n" being a natural number and "m" being a natural number less than "n", the reference axis passing through the center of the enclosure and a center of the plurality of the light emitting devices on the mounting surface, and the line being a straight line between the center of the enclosure and a first intersection point at an intersection between the segment and the outer surface of the enclosure. The radius of the circle may correspond to a distance from the center of the circle to a symmetrical point, the symmetrical point being where the circle tangentially touches the reference axis, and the prescribed shape of the optical surface may correspond to a portion of the circle that extends from the symmetrical point to a second intersection point at an intersection between the circle and the inner surface of the optical part. Moreover, an inner surface of the enclosure may have a textured surface having a prescribed roughness that is greater than a roughness of an outer surface of the enclosure.

In one embodiment, a lighting device may include a heat sink, at least one light emitting diode provided over the heat sink, an enclosure having a prescribed shape provided over the at least one light emitting diode, the enclosure including luminescent material such that a wavelength of light emitted by the enclosure is different from a wavelength of light emitted by the at least one light emitting diode, and a bulb provided over the heat sink to surround the enclosure, wherein the enclosure has a first region and a second region, a curvature of the first region being different than that of the second region.

A mounting platform may be provided over the heat sink and a substrate mounted on the mounting platform, wherein the at least one light emitting diode is mounted on the substrate at the mounting platform. The second region may have a curved shape and the curvature of the first region corresponds to a portion of a first virtual sphere and a curvature of the second region corresponds to a portion of a second virtual sphere, wherein a center of the first sphere is positioned a prescribed distance from a center of the second sphere. The center of the second sphere may be positioned at a center of the plurality of the light emitting diodes and the center of the first sphere may be positioned over the center of the second sphere, the prescribed distance between the center of the first sphere and the center of the second sphere being less than a radius of the first sphere.

The prescribed distance between the center of the first sphere and the center of the second sphere may be greater than a radius of the first sphere, wherein a center of the plurality of the light emitting diodes is located between the center of the first sphere and the center of the second sphere. A distance between the center of the second sphere and the center of the plurality of the light emitting diodes may be substantially the same as a difference between the radius of the first sphere and the radius of the second sphere. The at least one light emitting diode may have a prescribed angular range of light distribution, wherein a surface area of the first region of the enclosure is the same as an area of a virtual circle having a diameter equal to a width of the light distribution range measured at a height equal to a height of the first region.

The first region of the enclosure may be formed of a plurality of sub-regions positioned over a corresponding one of the at least one light emitting diode, the at least one light emitting diode being arranged along a virtual circle on a mounting surface of the heat sink. The second region of the enclosure may extend from the first region to the heat sink, and a width of the second region at the heat sink may be greater than a diameter of the virtual circle. A ratio of a distance between any one of the light emitting devices and a corresponding sub-region of the enclosure to the width of the second region at the heat sink may be greater than or equal to 0.8 and less than or equal to 1.2.

In one embodiment, the lighting device may include a heat sink; a member disposed on the heat sink; a light source unit disposed on the member; a spherical shaped optical part which is disposed on the light source unit, is coupled to the member and changes the wavelength of light emitted from the light source unit; and a cover which is disposed on the optical part and is coupled to the heat sink.

In one embodiment, the lighting device may include a heat sink which includes a projection; a light source unit disposed on the projection of the heat sink; a cover which is disposed over the light source unit and is coupled to the heat sink; and a spherical shaped optical part which is disposed between the light source unit and the cover, is coupled to the projection of the heat sink and changes the wavelength of light emitted from the light source unit.

In one embodiment, the lighting device may include a heat sink which includes a placement portion; a light source unit which includes a substrate disposed on the placement portion of the heat sink and includes a plurality of light emitting devices disposed on the substrate; a cover which is disposed over the light source unit and is coupled to the heat sink; and an optical part which is disposed between the light source unit and the cover and changes the wavelength of light emitted from the light source unit. The optical part includes an upper portion which is disposed over the light emitting device and a lower portion which is connected to the upper portion and is coupled to the heat sink. The upper portion of the optical part is a portion of a hollow sphere. The lower portion of the optical part supports the upper portion of the optical part.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink;

a plurality of light emitting devices provided over the heat sink;

an enclosure having a prescribed shape provided over the at least one light emitting device, the enclosure including luminescent material such that a wavelength of light emitted by the enclosure is different from a wavelength of light emitted by the plurality of light emitting devices; and a bulb provided over the heat sink to surround the enclosure, wherein the enclosure has a first region and a second region, the second region extending at a prescribed angle from the first region, wherein the first region is a portion of a first virtual sphere, wherein the second region is a portion of a second virtual sphere, wherein the first region is disposed over the second region and the plurality of the light emitting devices, and wherein a center of the second virtual sphere is positioned over a center of the first virtual sphere.

2. The lighting device of claim 1, further including a mounting platform provided over the heat sink and a substrate mounted on the mounting platform, wherein the plurality of light emitting devices are mounted on the substrate at the mounting platform.

3. The lighting device of claim 1, wherein the center of the second virtual sphere is positioned at a center of the plurality of the light emitting devices and the center of the first virtual sphere is positioned over the center of the second virtual sphere, a prescribed distance between the center of the first virtual sphere and the center of the second virtual sphere being less than a radius of the first virtual sphere.

4. The lighting device of claim 1, wherein a prescribed distance between the center of the first virtual sphere and the center of the second virtual sphere is greater than a radius of the first virtual sphere, and wherein a center of the plurality of the light emitting devices is located between the center of the first virtual sphere and the center of the second virtual sphere.

5. The lighting device of claim 4, wherein a distance between the center of the second virtual sphere and the center of the plurality of the light emitting devices is substantially the same as a difference between the radius of the first virtual sphere and the radius of the second virtual sphere.

6. The lighting device of claim 1, wherein the at least one light emitting device has a prescribed angular range of light distribution, and wherein a surface area of the first region of the enclosure is the same as an area of a virtual circle having a diameter equal to a width of the light distribution range measured at a height equal to a height of the first region.

7. The lighting device of claim 1, wherein the first region of the enclosure is formed of a plurality of sub-regions, each of the plurality of sub-regions positioned over a corresponding one of the plurality of light emitting devices, wherein the plurality of light emitting devices are arranged along a virtual circle on a mounting surface of the heat sink, and wherein each of the plurality of sub-regions correspond to a portion of a virtual sphere.

8. The lighting device of claim 7, wherein the second region of the enclosure extends from the first region to the heat sink, and a width of the second region at the heat sink is greater than a diameter of the virtual circle.

9. The lighting device of claim 7, wherein a ratio of a distance between any one of the light emitting devices and a corresponding sub-region of the enclosure to the width of the second region at the heat sink is greater than or equal to 0.8 and less than or equal to 1.2.

10. The lighting device of claim 1, further comprising a mounting surface provided a prescribed distance over the heat sink, wherein the plurality of light emitting devices are positioned a prescribed distance from a point on the mounting surface, and wherein a ratio of the prescribed distance from the point to the light emitting devices to a distance from the point to an edge of the mounting surface is greater than or equal to 0.65 and less than 1.0.

11. The lighting device of claim 1, further comprising a mounting surface provided a prescribed distance over the heat sink, wherein the plurality of light emitting devices are positioned a prescribed distance from a point on the mounting surface, and wherein a ratio of a maximum distance from the point on the mounting surface to the enclosure to a width of the enclosure is greater than 0.72 and less than 1.

12. The lighting device of claim 1, further comprising a mounting surface provided a prescribed distance over the heat sink, wherein the plurality of light emitting devices are positioned a prescribed distance from a point on the mounting surface, and wherein the point is positioned at a center of the mounting surface and the plurality of light emitting devices are not positioned at the center of the mounting surface.

13. The lighting device of claim 1, further comprising a mounting surface provided a prescribed distance over the heat sink, wherein the plurality of light emitting devices are positioned a prescribed distance from a point on the mounting surface, and wherein the plurality of light emitting devices are positioned in a circular or oval pattern around the point on the mounting surface and the point is positioned at a center of the plurality of light emitting devices.

14. The lighting device of claim 1, wherein an inner surface of the enclosure is a textured surface having a prescribed roughness that is greater than a roughness of an outer surface of the enclosure.

* * * * *